US010836410B2

(12) United States Patent
Sano et al.

(10) Patent No.: US 10,836,410 B2
(45) Date of Patent: Nov. 17, 2020

(54) CARBODY OF RAILCAR

(71) Applicant: KAWASAKI JUKOGYO KABUSHIKI KAISHA, Kobe (JP)

(72) Inventors: Atsushi Sano, Kobe (JP); Naoaki Kawakami, Kobe (JP); Naohiro Yoshida, Kobe (JP); Shinichiro Hata, Kobe (JP); Seiichiro Yagi, Akashi (JP); Masayuki Tomizawa, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 354 days.

(21) Appl. No.: 15/563,748

(22) PCT Filed: May 31, 2016

(86) PCT No.: PCT/JP2016/002622
§ 371 (c)(1),
(2) Date: Oct. 2, 2017

(87) PCT Pub. No.: WO2016/194364
PCT Pub. Date: Dec. 8, 2016

(65) Prior Publication Data

US 2018/0079432 A1 Mar. 22, 2018

(30) Foreign Application Priority Data

Jun. 3, 2015 (JP) ..... 2015-112946

(51) Int. Cl.
*B61F 19/04* (2006.01)
*B61D 17/06* (2006.01)
(Continued)

(52) U.S. Cl.
CPC ..... *B61F 19/04* (2013.01); *B61D 15/06* (2013.01); *B61D 17/06* (2013.01); *B61F 1/10* (2013.01); *B61G 11/16* (2013.01)

(58) Field of Classification Search
CPC ..... B61F 19/04; B61D 15/06; B60R 19/34; B61G 11/16
See application file for complete search history.

(56) References Cited

U.S. PATENT DOCUMENTS 5,579,699 A * 12/1996 Dannawi ..... B60R 19/18 105/416
6,167,815 B1 * 1/2001 Werner ..... B61F 19/04 105/392.5
(Continued)

FOREIGN PATENT DOCUMENTS

JP 2004-268694 A 9/2004
JP 2007-302081 A 11/2007
(Continued)

OTHER PUBLICATIONS

Aug. 30, 2016 Search Report issued in International Patent Application No. PCT/JP2016/002622.
(Continued)

*Primary Examiner* — Zachary L Kuhfuss
(74) *Attorney, Agent, or Firm* — Oliff PLC

(57) ABSTRACT

A carbody of a railcar includes: an underframe; a first member provided at one of vertical sides of a vertical center of the underframe, supported by the underframe, and absorbing collision energy; a second member provided at the other vertical side of the vertical center of the underframe, supported by the underframe, and contacting an obstacle when the first member is compressed by collision with the obstacle. In a case where the second member receives a reaction force from the obstacle when the first member is compressed by the collision with the obstacle, the second member transfers to the underframe a moment load that is opposite in a rotational direction to a moment load transferred to the underframe by the first member.

7 Claims, 10 Drawing Sheets

(51) Int. Cl.

| | |
|---|---|
| ***B61G 11/16*** | (2006.01) |
| ***B61D 15/06*** | (2006.01) |
| ***B61F 1/10*** | (2006.01) |

(56) References Cited

U.S. PATENT DOCUMENTS

| | | | | |
|---|---|---|---|---|
| 7,536,958 | B2 * | 5/2009 | Bravo | B61C 17/04 105/340 |
| 7,810,437 | B2 * | 10/2010 | Mattschull | B60R 19/14 105/392.5 |
| 8,261,672 | B2 * | 9/2012 | Heinisch | B61C 17/04 105/392.5 |
| 8,646,392 | B2 * | 2/2014 | Graf | B61F 1/10 105/392.5 |
| 9,027,485 | B2 * | 5/2015 | Taguchi | B61D 17/06 105/173 |
| 9,242,655 | B2 * | 1/2016 | Taguchi | B61D 15/06 |
| 9,409,580 | B2 * | 8/2016 | Fan | B61F 19/04 |
| 10,017,192 | B2 * | 7/2018 | Sano | B61D 15/06 |
| 10,124,816 | B2 * | 11/2018 | Nagahara | B61D 15/06 |
| 2007/0261591 | A1 | 11/2007 | Bravo et al. | |
| 2007/0261592 | A1 * | 11/2007 | Mochida | B61D 15/06 105/392.5 |
| 2007/0283843 | A1 * | 12/2007 | Kawasaki | B61D 15/06 105/396 |
| 2007/0284328 | A1 * | 12/2007 | Mochida | B61D 15/06 213/221 |
| 2008/0116720 | A1 * | 5/2008 | Yamaguchi | B61D 15/06 296/187.11 |
| 2008/0236440 | A1 * | 10/2008 | Nakamura | B61D 15/06 105/392.5 |
| 2008/0236965 | A1 * | 10/2008 | Nakamura | B61D 15/06 188/268 |
| 2010/0064931 | A1 * | 3/2010 | Heinisch | B61C 17/04 105/392.5 |
| 2016/0167679 | A1 * | 6/2016 | Sano | B61D 15/06 105/392.5 |
| 2018/0079432 | A1 * | 3/2018 | Sano | B61D 15/06 |
| 2019/0039631 | A1 * | 2/2019 | Tian | B61D 15/06 |
| 2019/0077420 | A1 * | 3/2019 | Debost | B61D 15/06 |

FOREIGN PATENT DOCUMENTS

| | | | |
|---|---|---|---|
| JP | 2009-107590 | A | 5/2009 |
| JP | 2015-30336 | A | 2/2015 |
| PL | 67713 | Y1 | 4/2015 |
| WO | 02/18189 | A1 | 3/2002 |

OTHER PUBLICATIONS

Dec. 5, 2017 International Preliminary Report on Patentability issued in International Patent Application No. PCT/JP2016/002622.

* cited by examiner

CARBODY OF RAILCAR

TECHNICAL FIELD

The present invention relates to a carbody of a railcar.

BACKGROUND ART

An energy absorber is known, which is attached to a forward/rearward direction (car longitudinal direction) end portion of a carbody underframe of a railcar so as to project forward and absorbs collision energy when the railcar collides with an obstacle (see PTL 1, for example). Such an energy absorber is constituted by, for example, a hollow tubular member. When the railcar collides with the obstacle, the energy absorber causes plastic deformation in a bellows shape to absorb the collision energy.

CITATION LIST

Patent Literature

PTL 1: Japanese Laid-Open Patent Application Publication No. 2015-30336

SUMMARY OF INVENTION

Technical Problem

For example, because of reasons of design, the energy absorber may be provided at a lower side of a vertical center of the underframe. In such a case, when the railcar collides with the obstacle, a moment load in a pitching direction is transferred from the energy absorber to the underframe. In this case, the moment load may push the underframe upward, and the railcar may float up. Further, a structure that supports the energy absorber needs to be strong, and this increases the weight of the carbody.

An object of the present invention to stabilize the posture of a carbody at the time of collision while simplifying the structure of the carbody and reducing the weight of the carbody.

Solution to Problem

A carbody of a railcar according to one aspect of the present invention includes: an underframe; a first member provided at one of vertical sides of a vertical center of the underframe, supported by the underframe, and absorbing collision energy; a second member provided at the other vertical side of the vertical center of the underframe, supported by the underframe, and contacting an obstacle when the first member is compressed by collision with the obstacle, in a case where the second member receives a reaction force from the obstacle when the first member is compressed by the collision with the obstacle, the second member transferring to the underframe a moment load that is opposite in a rotational direction to a moment load transferred to the underframe by the first member.

According to the above configuration, even when the first member transfers the moment load to the underframe by the collision with the obstacle, the second member transfers the opposite rotational direction moment load to the underframe. Therefore, the moment loads act so as to cancel each other. Thus, the posture of the carbody at the time of collision can be stabilized while simplifying the structure of the carbody and reducing the weight of the carbody.

Advantageous Effects of Invention

According to the present invention, the posture of the carbody at the time of collision can be stabilized while simplifying the structure of the carbody and reducing the weight of the carbody.

DESCRIPTION OF EMBODIMENTS

Figure 2:
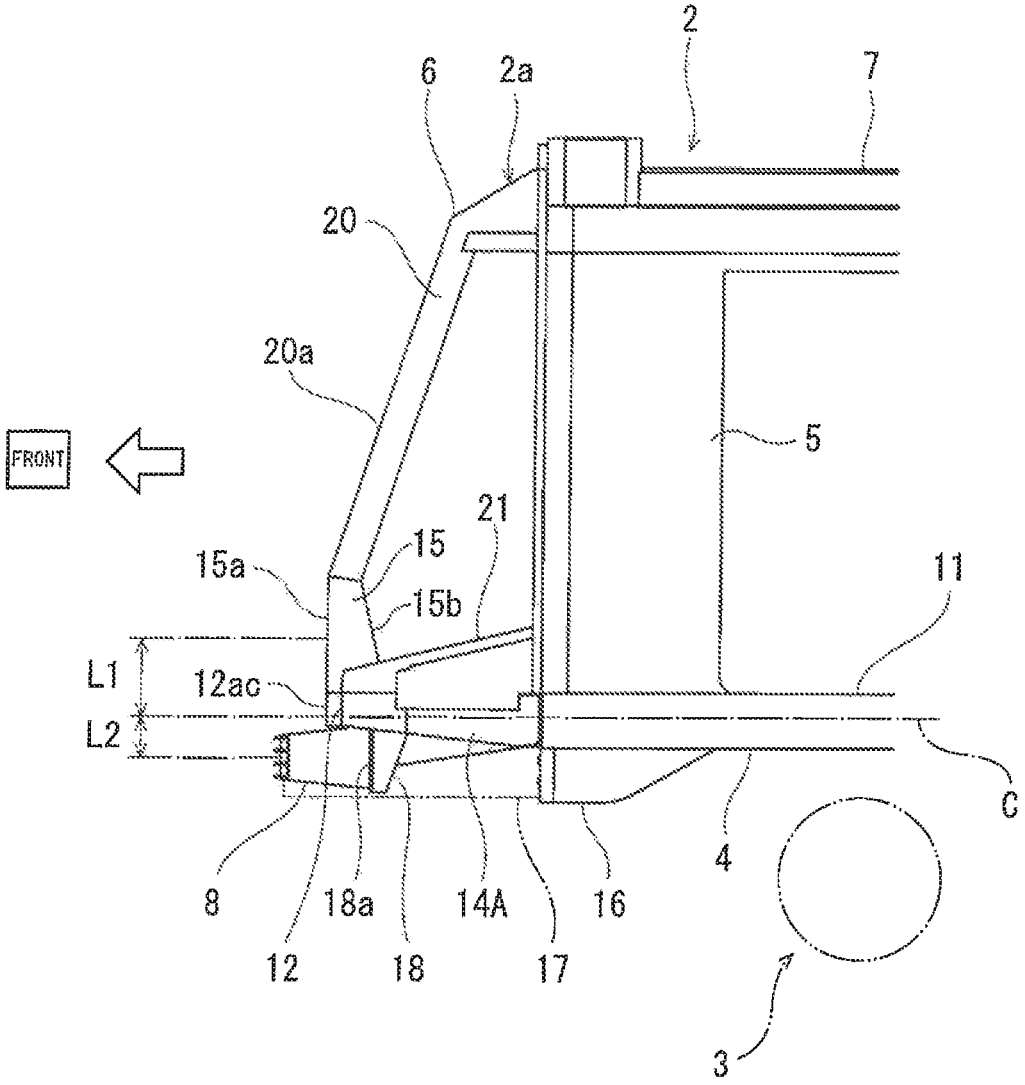
FIG. 2 is a side view showing the head portion of the carbody shown in FIG. 1.
Figure 3:
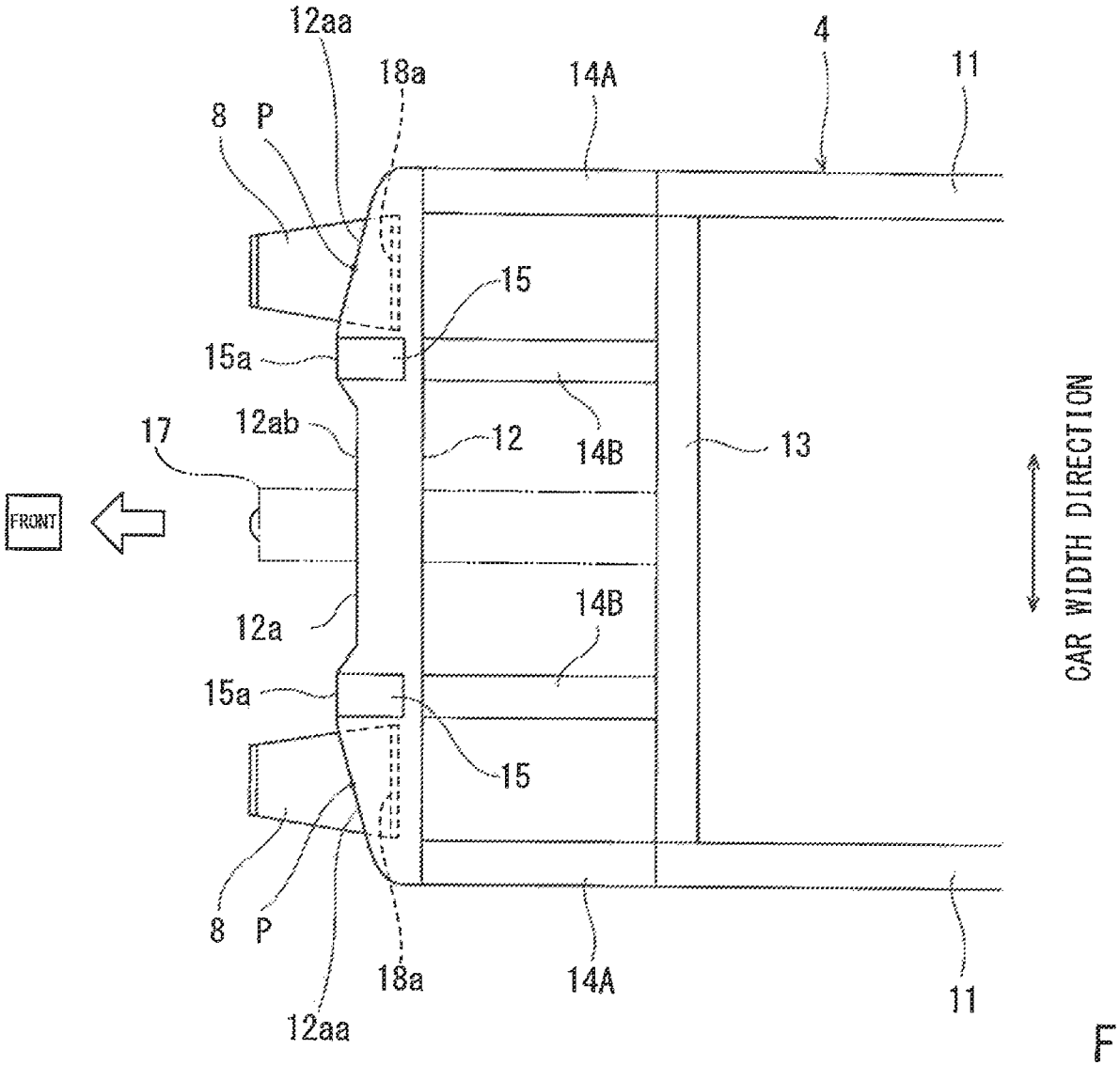
FIG. 3 is a plan view showing an underframe and an energy absorber at the head portion of the carbody shown in FIG. 1.

Hereinafter, embodiments will be explained in reference to the drawings. In the following embodiments, a direction in which a railcar 1 travels, in other words, a direction in which a carbody 2 extends is referred to as a forward/rearward direction (or a car longitudinal direction), and a lateral direction perpendicular to the forward/rearward direction is referred to as a car width direction. The railcar 1 can travel in both directions along the car longitudinal direction. However, in the following explanation, a left direction in FIGS. 1 to 3 is defined as a forward direction, and a right direction therein is defined as a rearward direction.

Embodiment 1

Figure 1:
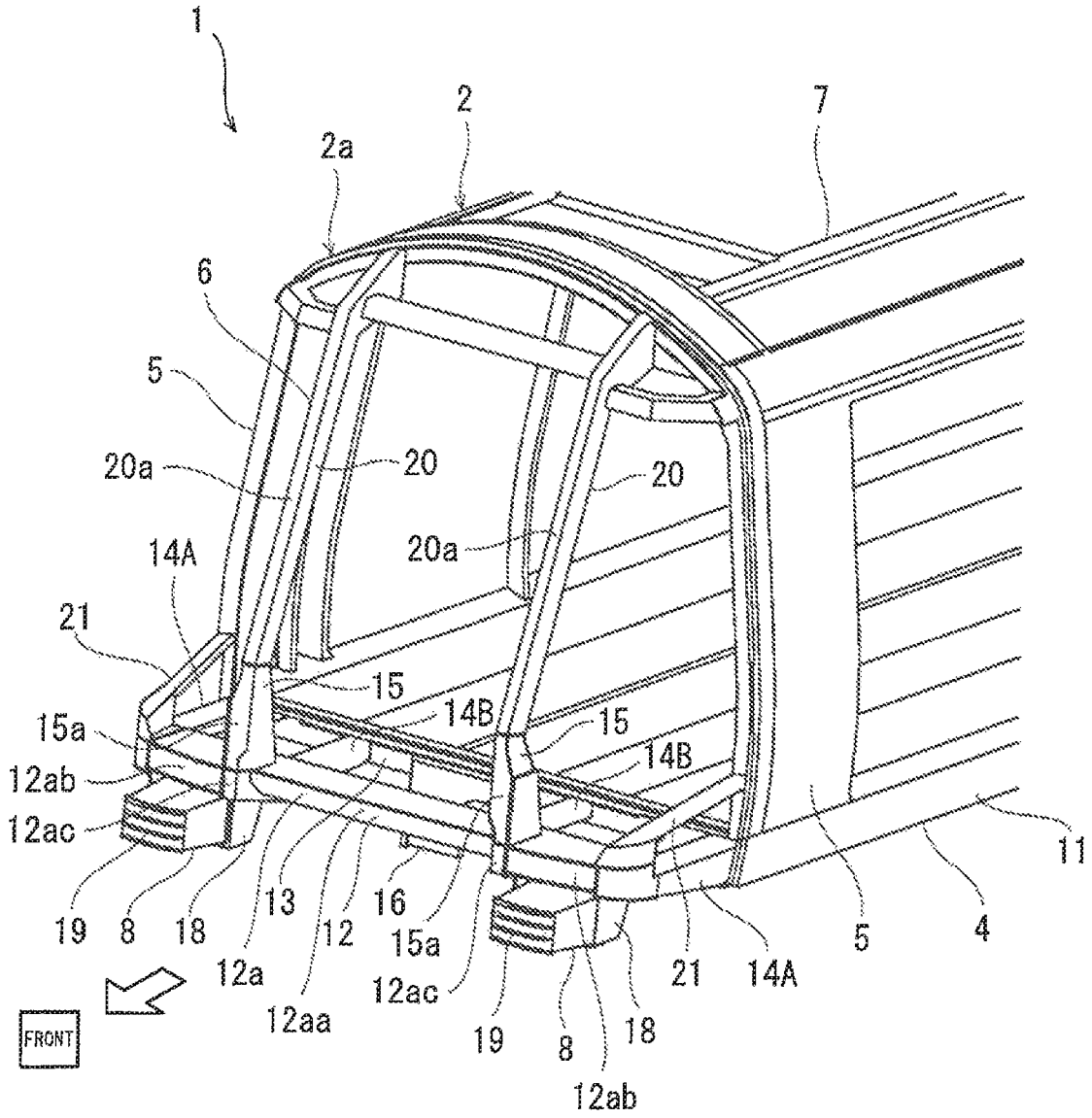
FIG. 1 is a perspective view showing a head portion of a carbody of a railcar according to Embodiment 1.

FIG. 1 is a perspective view showing a head portion 2*a* of the carbody 2 of the railcar 1 according to Embodiment 1. FIG. 2 is a side view showing the head portion 2*a* of the carbody 2 shown in FIG. 1. FIG. 3 is a plan view showing an underframe 4 and an energy absorber 8 at the head portion 2*a* of the carbody 2 shown in FIG. 1. As shown in FIGS. 1 to 3, the railcar 1 includes the carbody 2 and a bogie 3. The carbody 2 includes: the underframe 4 that is a carbody bottom portion; side bodyshells 5; a head bodyshell 6; and a roof bodyshell 7. Each of the side bodyshells 5 includes a door opening portion. Lower end portions of the side bodyshells 5 are connected to respective car width direction side portions of the underframe 4. A lower end portion of the head bodyshell 6 is connected to a forward/rearward direction (longitudinal direction) end portion of the underframe 4. The roof bodyshell 7 is connected to upper end portions of the side bodyshells 5 and an upper end portion of the head bodyshell 6.

The underframe 4 is provided symmetrically with respect to the car width direction. A plurality of (two, for example) first energy absorbers 8 (first members) projecting forward beyond the underframe 4 are fixed to a front end portion of the underframe 4. The underframe 4 includes a pair of side sills 11, a first end beam 12, a second end beam 13, and second energy absorbers 14A and 14B (third members). The side sills 11 are provided at both respective car width direction sides and extend in the car longitudinal direction. The first end beam 12 is provided at the front end portion of the underframe 4 and extends in the car width direction. The second end beam 13 is provided behind the first end beam 12 (at an inner side in the car longitudinal direction) and extends in the car width direction. The second energy absorbers 14A and 14B connect the first end beam 12 to the second end beam 13.

The first end beam 12 is provided away from front end portions of the side sills 11 in the forward direction. Lower end portions of a pair of collision posts 15 (second members) constituting the head bodyshell 6 are fixed to the first end beam 12. The collision posts 15 are fixed to positions displaced forward with respect to the first end beam 12. In a front surface 12*a* of the first end beam 12, each of outside portions 12*ab* located outside the collision posts 15 in the car width direction is inclined rearward as it extends outward in the car width direction. In the front surface 12*a* of the first end beam 12, a middle portion 12*aa* located between the collision posts 15 is concave rearward. To be specific, in the front surface 12*a* of the first end beam 12, portions closest to the collision posts 15 are located frontmost.

The second end beam 13 couples the front end portions of the side sills 11 to each other in the car width direction. The second end beam 13 continuously and linearly extends from one of the side sills 11 to the other side sill 11. A coupler supporting member 16 is fixed to a lower surface of a car width direction middle portion of the second end beam 13. A rear end of a coupler 17 extending forward beyond the first end beam 12 in a plan view is fixed to the coupler supporting member 16. A plurality of (four, for example) second energy absorbers 14A and 14B extend in the forward/rearward direction between the first end beam 12 and the second end beam 13 and are spaced apart from one another in the car width direction.

The second energy absorbers 14A and 14B are made of metal or FRP. Each of the second energy absorbers 14A and 14B has such a structure as to more easily cause plastic deformation by a compressive force in the forward/rearward direction than each of the side sills 11. As one example, each of the second energy absorbers 14A and 14B may have such a structure as to include a plurality of thin portions spaced apart from one another in the forward/rearward direction or may have a known structure. In a side view of the head portion 2*a* of the carbody 2, each of the second energy absorbers 14A and 14B is provided at a height position overlapping a vertical center of the underframe 4. Specifically, in the side view of the head portion 2*a* of the carbody 2, each of the second energy absorbers 14A and 14B is provided so as to overlap a center line C of the side sill 11, the center line C extending in the forward/rearward direction.

Absorber supporting members 18 are fixed to respective lower surfaces of car width direction outer sides (right and left sides) of the first end beam 12, the car width direction outer sides being located outside the respective collision posts 15. Each of the absorber supporting members 18 connects the first energy absorber 8 to the first end beam 12 of the underframe 4. The absorber supporting member 18 includes a supporting surface 18*a*, and the supporting surface 18*a* supports the first energy absorber 8 from behind. The supporting surface 18*a* is a vertical surface whose normal line extends in the forward direction, and a rear end of the first energy absorber 8 is fixed to the supporting surface 18*a*. All the first energy absorbers 8 are provided at a lower side of the vertical center of the underframe 4 and supported by the underframe 4 through the absorber supporting members 18. The first energy absorber 8 is located outside the collision post 15 in the car width direction.

The supporting surface 18*a* of the absorber supporting member 18 is located behind a front surface of the underframe 4 (i.e., behind the front surface 12*a* of the first end beam 12). The first energy absorber 8 projects forward beyond the front surface 12*a* of the first end beam 12 and a front surface 15*a* of the collision post 15. The first energy absorber 8 is made of metal or FRP. Each of a plurality of (two, for example) first energy absorbers 8 has such a structure as to more easily cause plastic deformation by a compressive force in the forward/rearward direction than each of a plurality of (four, for example) second energy absorbers 14A and 14B. As one example, the first energy absorber 8 has such a tapered shape that a cross-sectional area of the first energy absorber 8 when viewed from front decreases as the first energy absorber 8 extends in the forward direction. The number of first energy absorbers 8 is smaller than the number of second energy absorbers 14A and 14B. Anti-climbers 19 are provided at respective front surfaces of the first energy absorbers 8. Each of the anti-climbers 19 is constituted by a plurality of plates that are spaced apart from one another in the vertical direction and extend in the car width direction.

The head bodyshell 6 includes the pair of collision posts 15, pillars 20, and side beams 21. The collision posts 15 project upward from the first end beam 12. Each of the pillars 20 extends from an upper end of the collision post 15 to the roof bodyshell 7. Each of the side beams 21 extends from a car width direction end portion of the first end beam 12 to a front end of the side bodyshell 5 obliquely upward and rearward. The collision posts 15 are provided at an upper side of the vertical center (center line C) of the underframe 4. The front surface 15*a* of the collision post 15 is a vertical surface whose normal line extends in the forward direction. In a side view of the head portion of the carbody, a rear surface 15*b* of the collision post 15 is inclined rearward as it extends downward. In a plan view of the head portion 2*a* of the carbody 2, the collision post 15 is provided so as to project forward beyond a portion P of the front surface 12*a* of the first end beam 12 (i.e., the front surface of the underframe 4), the portion P being the same in position in the car width direction as a car width direction center of the first energy absorber 8. A front end (front surface 15*a*) of the collision post 15 is located behind a front end of the first energy absorber 8 and in front of the rear end of the first energy absorber 8. Specifically, in a forward/rearward direction positional range from the front end of the first energy absorber 8 in a noncompressed state (before deformation) to the rear end thereof, when the position of the front end of the first energy absorber 8 is defined as a 0% position, and the position of the rear end of the first energy absorber 8 is defined as a 100% position, the position of the front end of the collision post 15 is set within a range from a 40% position to an 80% position. In the present embodiment, the collision post 15 is provided such that the position of the front end of the first energy absorber 8 when the first energy absorber 8 is compressed by an effective stroke amount becomes substantially the same as the position of the front end of the collision post 15. To be specific, the collision post 15 is provided so as to contact an obstacle when the first energy absorber 8 is compressed by the effective stroke amount by the collision with the obstacle. The effective stroke amount denotes a maximum compressed length in the forward/rearward direction when the energy absorber is compressed in the forward/rearward direction by collision to cause plastic deformation. It should be noted that the collision post 15 does not have to be provided so as to contact the obstacle when the first energy absorber 8 is compressed by the effective stroke amount by the collision with the obstacle. The first energy absorber 8 may be provided so as to contact the obstacle when the first energy absorber 8 is compressed by a stroke amount (predetermined stroke amount) that is smaller than the effective stroke amount.

The pillar 20 is inclined rearward as it extends upward. Therefore, the front surface 15*a* of the collision post 15 is located in front of the front surface 20*a* of the pillar 20. A vertical length of the collision post 15 is shorter than a vertical length of the pillar 20. A vertical distance L1 from a vertical center of the collision post 15 to the vertical center of the underframe 4 is longer than a vertical distance L2 from a vertical center of the first energy absorber 8 to the vertical center of the underframe 4. A total area S1 of the front surfaces 15*a* of the collision posts 15 located at an upper side of the underframe 4 is larger than a total area S2 of regions 12*ac* of the front surface (the front surface 12*a* of the first end beam 12) of the underframe 4, the regions 12*ac* being included in a virtual vertical surface including the front surfaces 15*a* of the collision posts 15. The total area S2 may be set to zero by providing the front surfaces 15*a* of the collision posts 15 in front of the front surface 12*a* of the first end beam 12.

Figure 4:
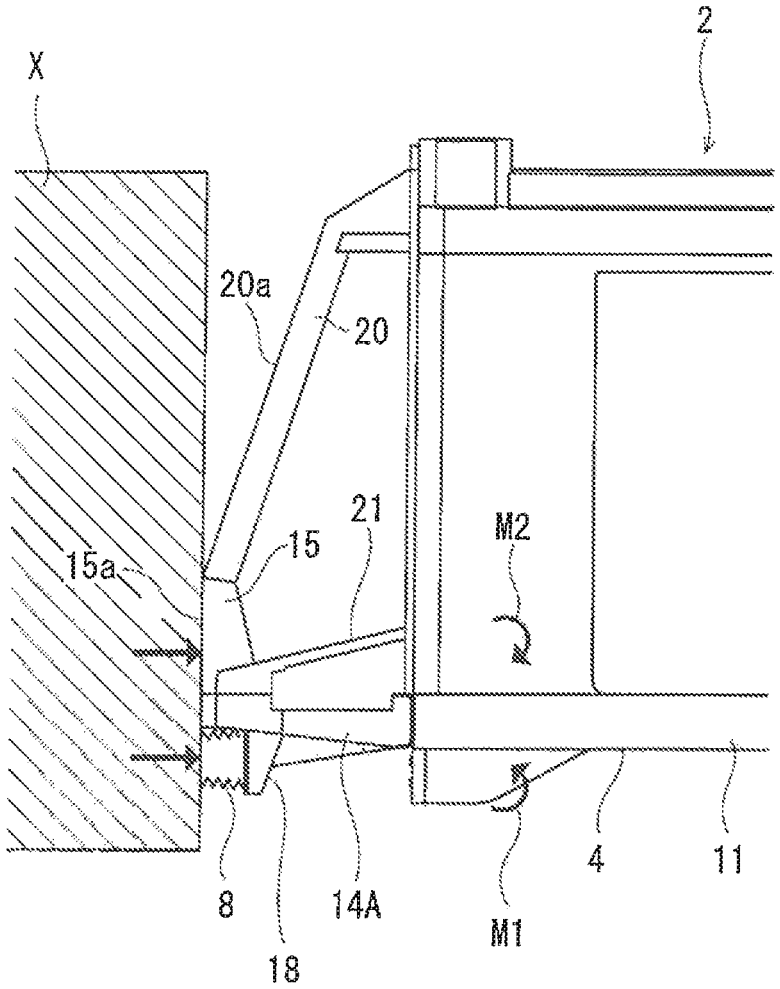
FIG. 4 is a side view for explaining collision of the carbody of FIG. 2 with an obstacle.

FIG. 4 is a side view for explaining the collision of the carbody 2 of FIG. 2 with an obstacle X. One example of the obstacle X is a railcar. As shown in FIG. 4, when the obstacle X collides with the carbody 2, first, the first energy absorber 8 contacts the obstacle X to be compressed in the forward/rearward direction, that is, cause plastic deformation in a bellows shape. Thus, the first energy absorber 8 absorbs the collision energy. Next, when the first energy absorber 8 is compressed by the effective stroke amount, the front surface 15*a* of the collision post 15 contacts the obstacle X. Then, the collision post 15 receives a reaction force from the obstacle X and transfers to the underframe 4 a moment load M2 that is opposite in a rotational direction to a pitching direction moment load M1 transferred to the underframe 4 by the first energy absorber 8 and the absorber supporting member 18.

According to the configuration explained as above, even when the first energy absorber 8 transfers the moment load M1 to the underframe 4 by the collision with the obstacle X, the collision post 15 transfers the opposite rotational direction moment load M2 to the underframe 4. Therefore, the moment loads M1 and M2 act so as to cancel each other. Thus, the posture of the carbody 2 at the time of collision can be stabilized while simplifying the structure of the carbody 2 and reducing the weight of the carbody 2. Further, since the moment load M2 acts so as to cancel the moment load M1, the absorber supporting member 18 can be simplified and reduced in weight. Furthermore, since a post member (collision post 15) constituting the bodyshell is utilized as a member that generates the moment load M2, the number of parts can be reduced.

The moment load M1 of the first energy absorber 8 and the moment load M2 of the collision post 15 act so as to cancel each other, and therefore, the posture of the first end beam 12 is stabilized. On this account, when an impact is high, the second energy absorbers 14A and 14B are compressed in a correct posture and can efficiently absorb the collision energy. Further, the vertical distance L1 from the vertical center of the collision post 15 to the vertical center of the underframe 4 is longer than the vertical distance L2 from the vertical center of the first energy absorber 8 to the vertical center of the underframe 4. Therefore, the moment load M2 transferred from the collision post 15 to the underframe 4 is effectively generated, and the floating of the carbody 2 by the moment load M1 transferred from the first energy absorber 8 to the underframe 4 can be appropriately prevented.

Embodiment 2

Figure 5:
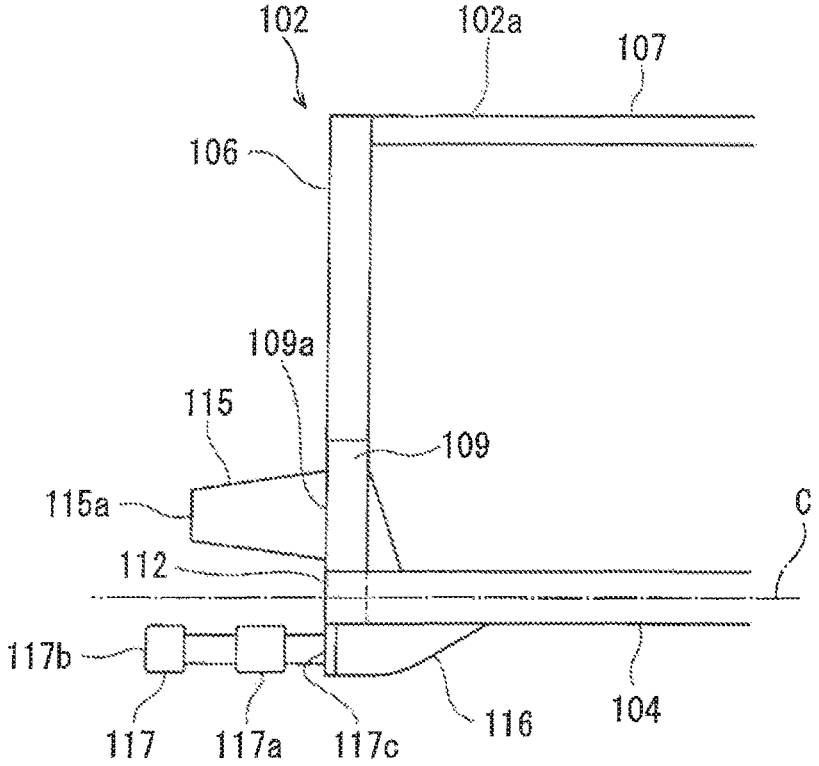
FIG. 5 is a side view showing the head portion of the carbody of the railcar according to Embodiment 2.

FIG. 5 is a side view showing a head portion 102*a* of a carbody 102 of a railcar according to Embodiment 2. As shown in FIG. 5, a coupler supporting member 116 is fixed to a lower surface of a car width direction middle portion of an end beam 112 provided at a front end portion of an underframe 104 and extending in the car width direction. A rear end of a coupler 117 (first member) extending forward beyond the end beam 112 in a plan view is fixed to the coupler supporting member 116. The coupler 117 includes an energy absorbing portion 117*a* that is compressed in the forward/rearward direction to absorb the collision energy when the obstacle X collides with the energy absorbing portion 117*a* from front. The energy absorbing portion 117*a* has a known structure that more easily causes plastic deformation than other portions of the coupler 117.

An absorber supporting member 109 extending upward from the end beam 112 is provided at a head bodyshell 106 that connects the end beam 112 to a roof bodyshell 107. The absorber supporting member 109 connects an energy absorber 115 (second member) to the end beam 112. The absorber supporting member 109 includes a supporting surface 109*a*, and the supporting surface 109*a* supports the energy absorber 115 from behind. The supporting surface 109*a* is a vertical surface whose normal line extends in the forward direction, and a rear end of the energy absorber 115 extending forward is fixed to the supporting surface 109*a*. The energy absorber 115 is provided at an upper side of a vertical center (center line C) of the underframe 104. A front end 115*a* of the energy absorber 115 is located behind a front end 117*b* of the coupler 117 and in front of a rear end 117*c* of the coupler 117.

Figure 6:
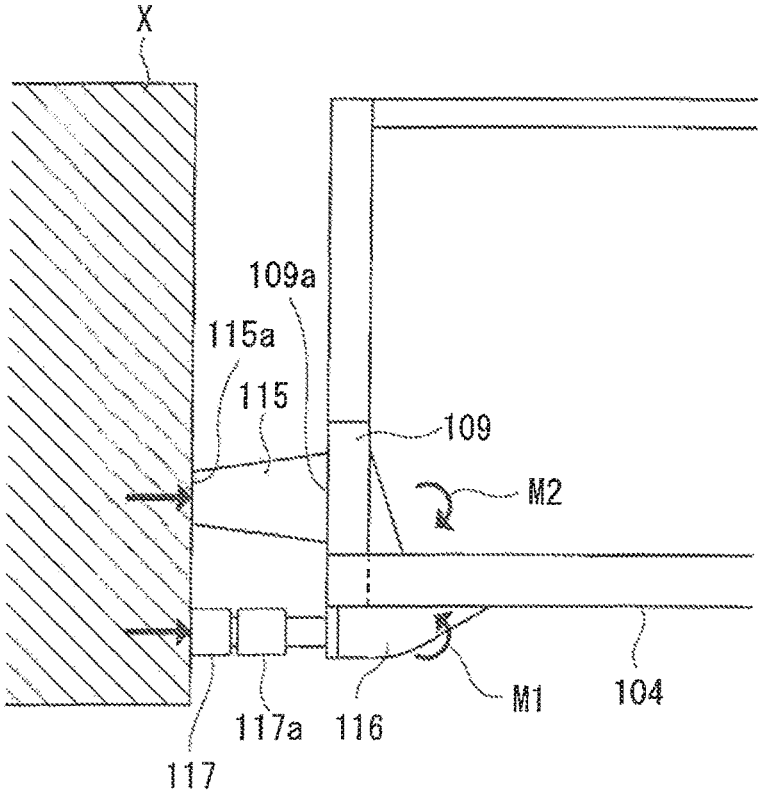
FIG. 6 is a side view for explaining the collision of the carbody of FIG. 5 with the obstacle.

FIG. 6 is a side view for explaining the collision of the carbody 102 of FIG. 5 with the obstacle X. As shown in FIG. 6, when the obstacle X collides with the carbody 102, first, the coupler 117 contacts the obstacle X to be compressed in the forward/rearward direction, that is, start absorbing the collision energy. Next, when the coupler 117 is compressed by a predetermined amount, the front end 115*a* of the energy absorber 115 contacts the obstacle X. From this state, both the coupler 117 and the energy absorber 115 absorb the collision energy. Then, the energy absorber 115 transfers to the underframe 104 the moment load M2 that is opposite in the rotational direction to the moment load M1 transferred to the underframe 104 by the coupler 117 and the coupler supporting member 116. With this, the moment loads M1 and M2 act so as to cancel each other, and the posture of the carbody at the time of collision can be stabilized while simplifying the structure of the carbody and reducing the weight of the carbody.

Embodiment 3

Figure 7:
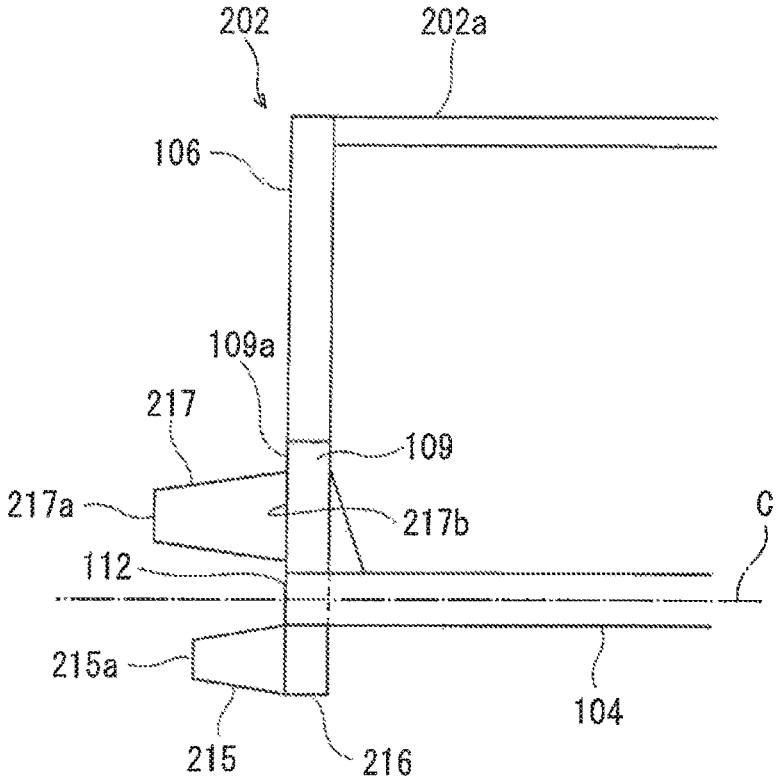
FIG. 7 is a side view showing the head portion of the carbody of the railcar according to Embodiment 3.

FIG. 7 is a side view showing a head portion of a carbody 202 of a railcar according to Embodiment 3. As shown in FIG. 7, the absorber supporting member 109 extending upward from the end beam 112 of the underframe 104 is provided at the head bodyshell 106. The absorber supporting member 109 connects a first energy absorber 217 (first member) to the end beam 112. The absorber supporting member 109 includes the supporting surface 109*a*, and the supporting surface 109*a* supports the first energy absorber 217 from behind. The supporting surface 109*a* is a vertical surface whose normal line extends in the forward direction. A rear end 217*b* of the first energy absorber 217 extending forward is fixed to the supporting surface 109*a*. The first energy absorber 217 is provided at an upper side of the vertical center (center line C) of the underframe 104.

An absorber supporting member 216 is fixed to a lower surface of the end beam 112. A rear end of a second energy absorber 215 (second member) extending forward is fixed to the absorber supporting member 216. To be specific, the second energy absorber 215 is provided at a lower side of the vertical center (center line C) of the underframe 104. A front end 215*a* of the second energy absorber 215 is located behind a front end of the first energy absorber 217 and in front of the rear end of the first energy absorber 217.

Figure 8:
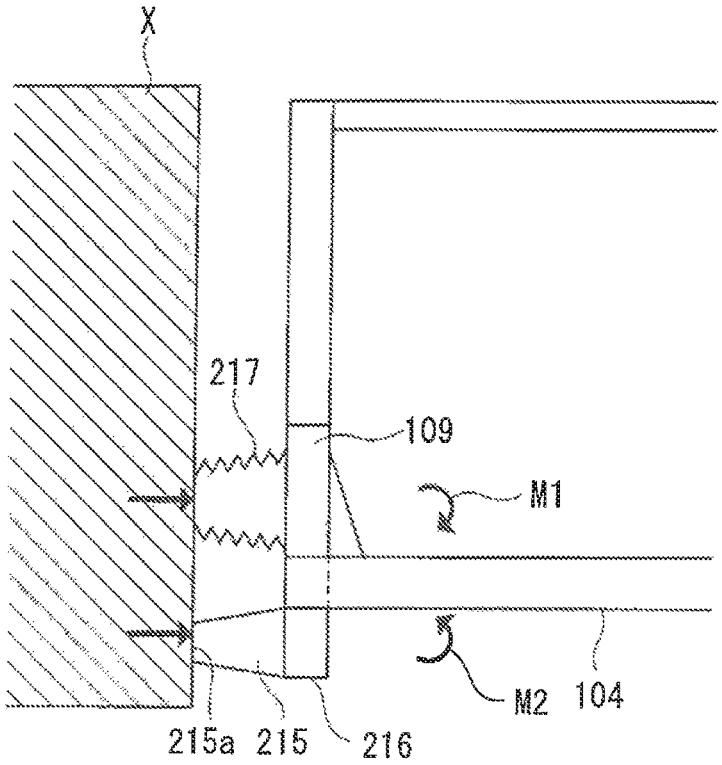
FIG. 8 is a side view for explaining the collision of the carbody of FIG. 7 with the obstacle.

FIG. 8 is a side view for explaining the collision of the carbody 202 of FIG. 7 with the obstacle X. As shown in FIG. 8, when the obstacle X collides with the carbody 202, first, the first energy absorber 217 contacts the obstacle X to be compressed in the forward/rearward direction, that is, start absorbing the collision energy. Next, when the first energy absorber 217 is compressed by a predetermined amount, the front end 215*a* of the second energy absorber 215 contacts the obstacle X. From this state, both the coupler 117 and the second energy absorber 215 absorb the collision energy. Then, the second energy absorber 215 transfers to the underframe 104 the moment load M2 that is opposite in the rotational direction to the moment load M1 transferred to the underframe 104 by the first energy absorber 217. With this, the moment loads M1 and M2 act so as to cancel each other, and the posture of the carbody at the time of collision can be stabilized while simplifying the structure of the carbody and reducing the weight of the carbody.

Embodiment 4

Figure 9:
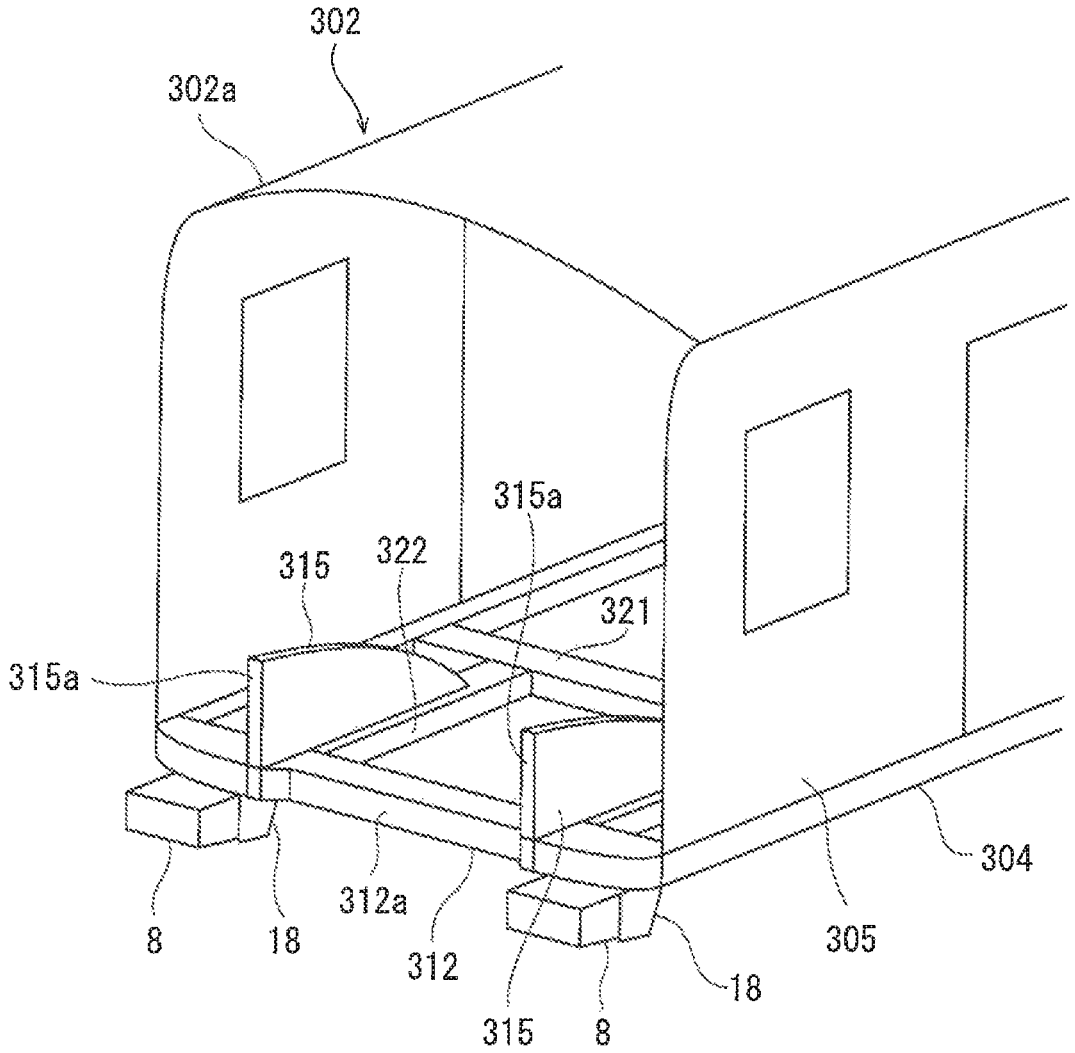
FIG. 9 is a perspective view showing the head portion of the carbody of the railcar according to Embodiment 4.
Figure 10:
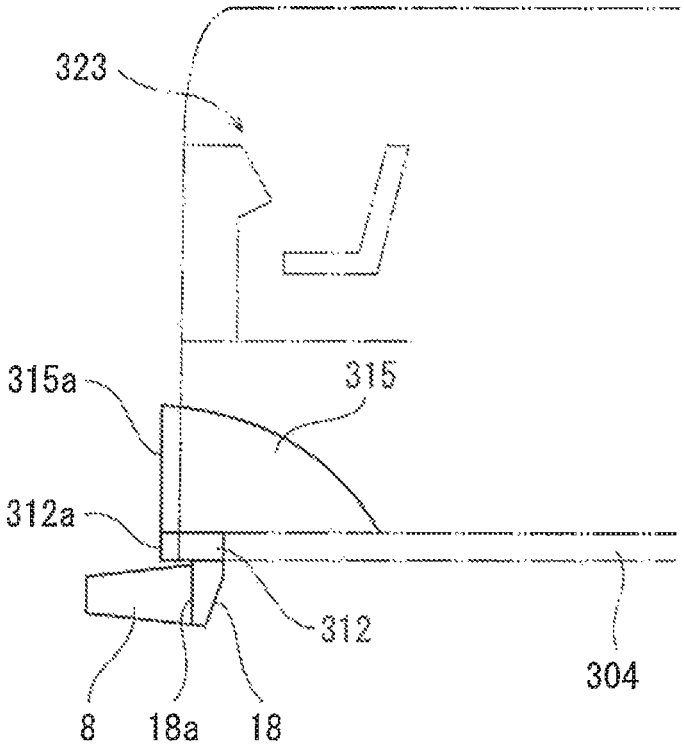
FIG. 10 is a side view showing major components of the head portion of the carbody shown in FIG. 9.

FIG. 9 is a perspective view showing a head portion 302*a* of a carbody 302 of a railcar according to Embodiment 4. FIG. 10 is a side view showing major components of the head portion 302*a* of the carbody 302 shown in FIG. 9. As shown in FIGS. 9 and 10, the absorber supporting member 18 is fixed to a lower surface of an end beam 312 of an underframe 304 of the carbody 302. The rear end of the first energy absorber 8 is fixed to the supporting surface 18*a* of the absorber supporting member 18. The supporting surface 18*a* of the absorber supporting member 18 is located behind the front surface of the underframe 304 (i.e., behind a front surface 312*a* of the end beam 312). The first energy absorber 8 projects forward beyond the front surface 312*a* of the end beam 312.

A pair of projecting posts 315 (post members) project upward from the end beam 312. A driver's cab 323 is provided in a space located immediately above the projecting posts 315. Upper ends of the projecting posts 315 are free ends. Each of the projecting posts 315 is supported by the end beam 312 from below and is also supported by a center sill 322 from below, the center sill 322 connecting the end beam 312 to a bolster beam 321. The projecting post 315 has such a shape as to decrease in height as it extends rearward. A front surface 315*a* of the projecting post 315 is a vertical surface whose normal line extends in the forward direction. In the front surface 312*a* of the end beam 312, portions closest to the projecting posts 315 are located at frontmost.

The front surface 315*a* of the projecting post 315 is located in front of a front end of a side bodyshell 305. The front surface 315*a* of the projecting post 315 is located behind the front end of the first energy absorber 8 and in front of the rear end of the first energy absorber 8. The projecting post 315 is provided so as to contact the obstacle when the first energy absorber 8 is compressed by the effective stroke amount by the collision with the obstacle. According to this, even when the first energy absorber 8 transfers the moment load to the underframe 304 by the collision with the obstacle, the projecting post 315 transfers the opposite rotational direction moment load to the underframe 304. Therefore, these moment loads act so as to cancel each other. Thus, the posture of the carbody 302 at the time of collision can be stabilized.

Embodiment 5

Figure 11:
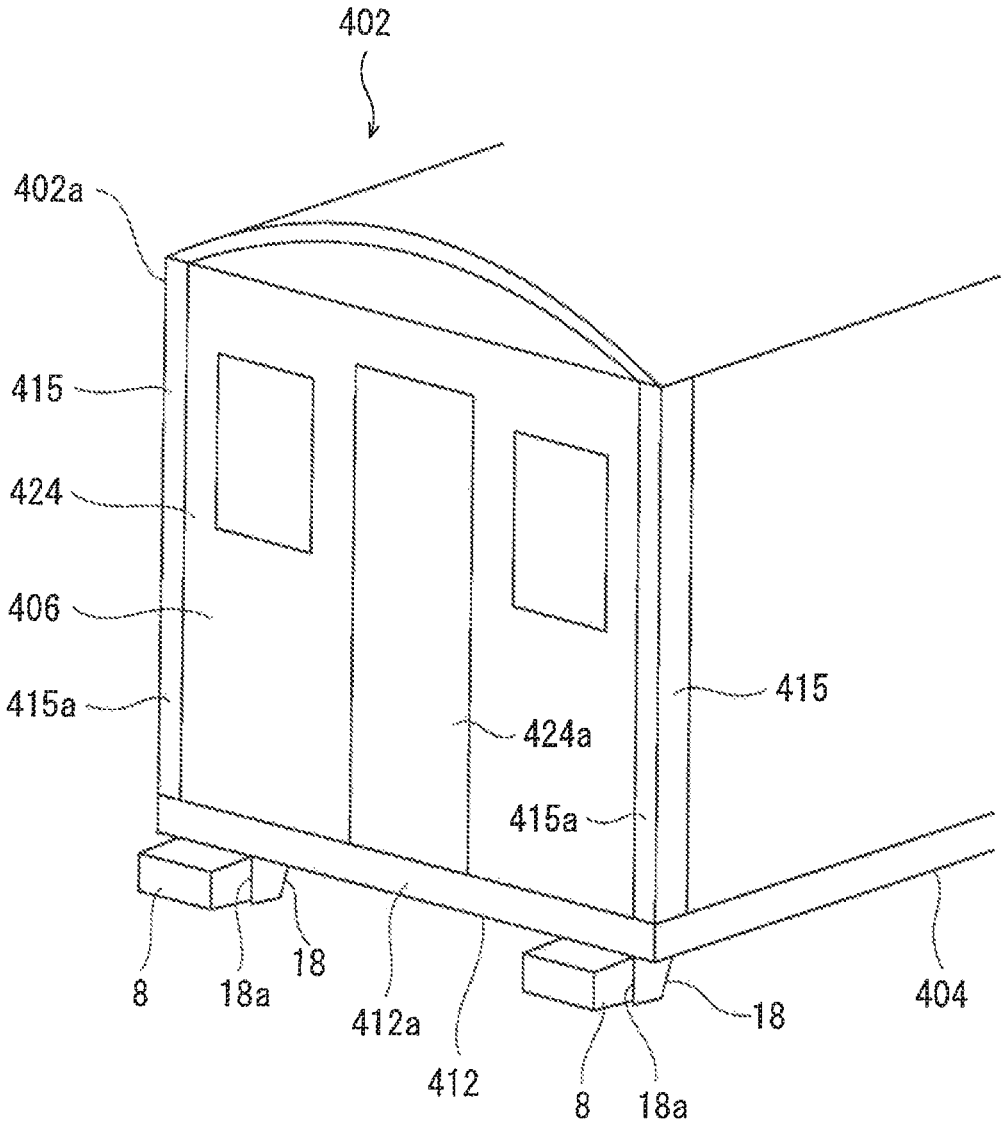
FIG. 11 is a perspective view showing an end part of the carbody of the railcar according to Embodiment 5.
Figure 12:
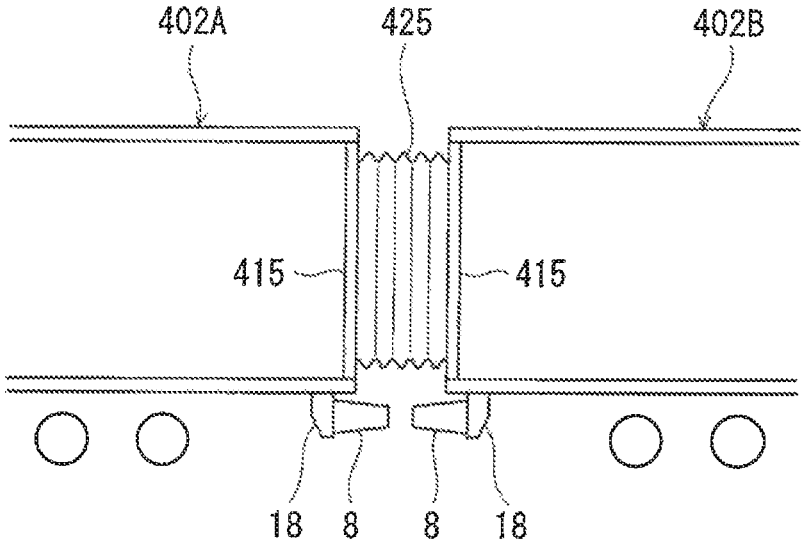
FIG. 12 is a side view for explaining a state where the carbody shown in FIG. 11 is coupled to an adjacent carbody.

FIG. 11 is a perspective view showing an end part 402*a* of a carbody 402 of a railcar according to Embodiment 5. FIG. 12 is a side view for explaining a state where a carbody 402A shown in FIG. 11 is coupled to an adjacent carbody 402B. As shown in FIG. 11, the absorber supporting member 18 is fixed to a lower surface of an end beam 412 of an underframe 404 of the carbody 402. The rear end of the first energy absorber 8 is fixed to the supporting surface 18*a* of the absorber supporting member 18. The supporting surface 18*a* of the absorber supporting member 18 is located behind a front surface of the underframe 404 (i.e., behind a front surface 412*a* of the end beam 412). The first energy absorber 8 projects forward beyond the front surface 412*a* of the end beam 412.

The front surface 412*a* of the end beam 412 of the underframe 404 extends linearly in the car width direction. A lower end portion of an end bodyshell 406 is fixed to the end beam 412. The end bodyshell 406 includes: an end outside plate 424 at which a gangway 424*a* opens; and corner posts 415 (post members) each fixed to a car width direction end portion of the end outside plate 424 and projecting upward from a car width direction end portion of the end beam 412. A front surface 415*a* of the corner post 415 is the same in position in the forward/rearward direction as the front surface 412*a* of the end beam 412 or is located in front of the front surface 412*a* of the end beam 412. The front surface 415*a* of the corner post 415 is a vertical surface whose normal line extends in the forward direction. The front surface 415*a* of the corner post 415 is located behind the front end of the first energy absorber 8 and in front of the rear end of the first energy absorber 8. The corner post 415 is provided so as to contact the obstacle when the first energy absorber 8 is compressed by the effective stroke amount by the collision with the obstacle.

As shown in FIG. 12, a plurality of carbodies 402A and 402B having the above configurations are coupled to each other to form a train set. In the train set, a diaphragm 425 having a bellows and tubular shape is provided between the end bodyshell 406 of the carbody 402A and the end bodyshell 406 of the carbody 402B. The gangway 424*a* of the carbody 402A and the gangway 424*a* of the carbody 402B communicate with each other through the diaphragm 425. The first energy absorber 8 of the carbody 402A and the first energy absorber 8 of the carbody 402B face each other with an interval in the forward/rearward direction. When a head car of the train set collides with the obstacle, the carbody 402A and the carbody 402B collide with each other in a pileup manner. In such a case, even when the first energy absorber 8 of the carbody 402A collides with the first energy absorber 8 of the carbody 402B to transfer the moment load to the underframe 404, the corner post 415 transfers the opposite rotational direction moment load to the underframe 404. Therefore, the moment loads act so as to cancel each other. Thus, the postures of the carbodies 402A and 402B at the time of collision can be stabilized while simplifying the structures of the carbodies and reducing the weights of the carbodies. As described above, the corner post 415 transfers the opposite rotational direction moment load to the underframe 404. However, the present embodiment is not limited to this. For example, the end outside plate 424 may transfer the opposite rotational direction moment load to the underframe 404.

The above embodiments may be combined arbitrarily. For example, a part of components in one embodiment may be applied to other embodiment. For example, the carbody may include the first energy absorber 8 of Embodiment 1 and the coupler 117 of Embodiment 2, and both the first energy absorber 8 and the coupler 117 may absorb the impact at the time of collision with the obstacle X. Further, the car may be configured such that a head portion thereof has the configuration of FIG. 1, and a rear portion thereof has the configuration of FIG. 11.

REFERENCE SIGNS LIST

1 railcar
2, 102, 202, 302, 402 carbody
4, 104, 304, 404 underframe
8, 217 first energy absorber (first member)
12 first end beam
13 second end beam
14A, 14B second energy absorber (third member)
15 collision post (second member, post member)
16, 116 coupler supporting member
18, 109, 216 absorber supporting member
18*a* supporting surface
115, 215 energy absorber (second member)
117 coupler (first member)
315 projecting post (post member)
415 corner post (post member)
C center line
M1, M2 moment load
X obstacle

The invention claimed is:

1. A carbody of a railcar,
the carbody comprising:
an underframe;
a first member provided at a vertically lower side of a vertical center of the underframe, supported by the underframe, and absorbing collision energy;
a supporting member including a supporting surface that supports the first member from behind, the supporting member fixed to and extending from a lower surface of the underframe, the lower surface of the underframe being a bottommost surface of the underframe; and
a second member provided at a vertically upper side of the vertical center of the underframe, supported by the underframe, and contacting an obstacle when the first member is compressed by collision with the obstacle,
in a case where the second member receives a reaction force from the obstacle when the first member is compressed by the collision with the obstacle, the second member transferring to the underframe a moment load that is opposite in a rotational direction to a moment load transferred to the underframe via the supporting member by the first member.

2. The carbody according to claim 1, wherein a front end of the second member is located behind a front end of the first member and in front of a rear end of the first member.

3. The carbody according to claim 1, wherein:
a vertical distance from a vertical center of the second member to the vertical center of the underframe is longer than a vertical distance from a vertical center of the first member to the vertical center of the underframe.

4. The carbody according to claim 1, wherein:
the first member is an energy absorber; and
the second member is a post member.

5. The carbody according to claim 4, wherein:
the underframe includes
a first end beam located at a front end portion of the underframe and extending in a car width direction,
a second end beam located behind the first end beam and extending in the car width direction, and
a third member connecting the first end beam to the second end beam; and
the third member is an energy absorber provided at a height position overlapping the vertical center of the underframe.

6. The carbody according to claim 1, further comprising a supporting member connecting the second member to the underframe and supporting the second member from behind, wherein
the second member is an energy absorber.

7. The carbody according to claim 1, wherein the second member contacts the obstacle when the first member is compressed by an effective stroke amount by the collision with the obstacle.

* * * * *